United States Patent [19]

Brüssing

[11] Patent Number: 4,991,332

[45] Date of Patent: Feb. 12, 1991

[54] SIGN BEARING INFORMATION OR INDICATING DIRECTION

[75] Inventor: Bernd Brüssing, Ulm, Fed. Rep. of Germany

[73] Assignee: Hans Friedrich Hefendehl, Kierspe, Fed. Rep. of Germany

[21] Appl. No.: 384,739

[22] Filed: Jul. 21, 1989

[30] Foreign Application Priority Data

Aug. 4, 1988 [DE] Fed. Rep. of Germany ... 8809955[U]

[51] Int. Cl.[5] ..... G09F 11/00

[52] U.S. Cl. ..... 40/490; 40/618

[58] Field of Search ..... 40/489, 490, 491, 611, 40/152, 152.1, 584, 618; 248/251, 447.1, 447.2

[56] References Cited

U.S. PATENT DOCUMENTS

| | | | |
|---|---|---|---|
| 1,738,273 | 12/1929 | Anderson | 40/152 |
| 1,773,586 | 8/1930 | Koering | 248/251 |
| 2,499,049 | 2/1950 | Yates | 40/618 X |
| 2,659,991 | 11/1953 | Strayer | 40/152 X |
| 3,384,333 | 5/1968 | Bohlman et al. | 248/251 |
| 4,839,974 | 6/1989 | Walter | 40/152 |

*Primary Examiner*—Peter A. Aschenbrenner
*Assistant Examiner*—J. Bonifanti
*Attorney, Agent, or Firm*—Herbert Dubno

[57] ABSTRACT

An information-bearing and direction indicating sign is described having at least one rectangular information carrier provided with printing, a pictogram or a direction-indicating symbol and a frame holding the exchangable information carrier releasably. The frame includes at least two longitudinally-extended members running parallel to each other, which are provided with a plurality of opposing longitudinally-running receiving grooves, in which the information carrier or carriers are held edgewise and are easily removable. The longitudinally-extended members can have a connecting piece at each end for attachment to a wall surface. Means for easily holding or releasing one or more of the information carriers may be provided in the opposing receiving grooves in adjacent pairs of longitudinally-extending members. The longitudinally-extended members can be rods or bars and the connecting pieces can be formed by angular pieces which engage in mounting pieces permanently attached to the wall surface.

10 Claims, 4 Drawing Sheets

SIGN BEARING INFORMATION OR INDICATING DIRECTION

FIELD OF THE INVENTION

My present invention relates to a sign bearing information or indicating direction for offices, courts, hospitals and like facilities.

BACKGROUND OF THE INVENTION

A sign bearing information and/or indicating direction can comprise at least one information carrier provided with printing, a pictogram or the like and a frame holding it.

Such direction-indicating and information-bearing signs are used in a great number of applications as name plates, direction indicators and the like in offices, public buildings such as government offices and courts, hospitals and the like.

In the known information-bearing and direction-indicating signs, however, it is disadvantageous and comparatively time-consuming to change the information on the sign, as may be required for a name change, for example, on a name plate, and in many signs there is no possiblity to change the information-bearing elements, their size and/or the number of information carriers in an easy way, although of course an entirely new sign can be made.

OBJECTS OF THE INVENTION

It is an object of my invention to provide an improved sign bearing information or indicating direction which has one or more easily exchangable information carriers of different sizes which may be held securely when mounted.

It is also an object of my invention to provide an improved sign bearing information or indicating direction in which the information carrier or carriers can be replaced without difficulty as the need requires, widened or replaced by other carriers of a different material.

SUMMARY OF THE INVENTION

These objects and others which will become more readily apparent hereinafter are attained in accordance with my invention in a sign bearing information and indicating direction having an information carrier and a frame.

According to my invention, each information carrier comprises a substantially rectangular plate and the frame comprises at least two substantially parallel longitudinally-extended members, advantageously bars, spaced from each other, which are provided with longitudinally running receiving grooves facing each other, for the information carriers or carrier, in which the edges of these carriers are inserted and are releasable therefrom. Connecting pieces are provided for attachment to a wall surface or the like on opposite ends of the longitudinally-extended members.

According to my invention, the longitudinally-extended members are chosen according to the length and number of the information carrier or carriers and/or can be cut to length. To provide for a larger number of signs it is also possible to arrange for a plurality of longitudinally-extended members parallel to each other which can then receive a row of information carriers between them so that several rows of information carriers can be formed. Since the information carriers are inserted only in the longitudinally-running receiving grooves, they can be easily removed and replaced and need no special attaching means. However the information carriers are not easily removable by casual passersby who are not knowledgeable. Thus information carriers of a variety of different materials can be used as long as these have a plate-like shape.

The information carriers can be square or rectangular and be of a variety of sizes. It is also advantageous when the longitudinally-extended members have a circular cross section and the longitudinally-running receiving grooves are oriented radially to the axis of the longitudinally-extended members, which may of course be bars or rods.

To provide a larger sign, each longitudinally-extended member can have two longitudinally-running receiving grooves which are diametrically opposed to each other in one advantageous embodiment. In the receiving grooves of the longitudinally-extended member running along an edge of the sign, a covering strip can also be inserted so that the entire longitudinally-extended member has a uniform cross section and pleasing appearance. The longitudinally-extended member advantageously comprises an extruded plastic pipe, which has a uniformly thick wall in the vicinity of the receiving groove and in other regions, whereby good stability is attained for the longitudinally-extended member.

The connecting pieces are advantageously formed by angular pieces, on whose one end protrudes a uniting portion fitting the inside cross section of the plastic pipe and whose other end is pushed releasably in a mounting piece rigidly attached to the wall surface. Thus the connecting piece may be formed by two semicircular parts, which contact inside the wall region of the longitudinally-extended member between the receiving grooves.

The mounting piece is formed advantageously as a cylindrical disk, which is provided with an axial passage for an attachment screw and which carries an annular bulge protruding exteriorly radially, which is lockable in an annular groove located inside the angular piece.

Similarly, the mounting piece can also be formed as a cylindrical sleeve, whose one end is partially closed by an attaching plate provided with a passage for an attaching screw and which has a locking tongue formed by two axially-extending openings, whose free end carries a radially outwardly directed locking lip, which locks into a recess in the cylindrical inside surface of the angular piece.

Finally, the receiving grooves can be provided with a plurality of clamping crosspieces running in the longitudinal direction of the receiving grooves in their opposing surfaces, which have semicircular cross sections and engage in locking grooves of the information carrier.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
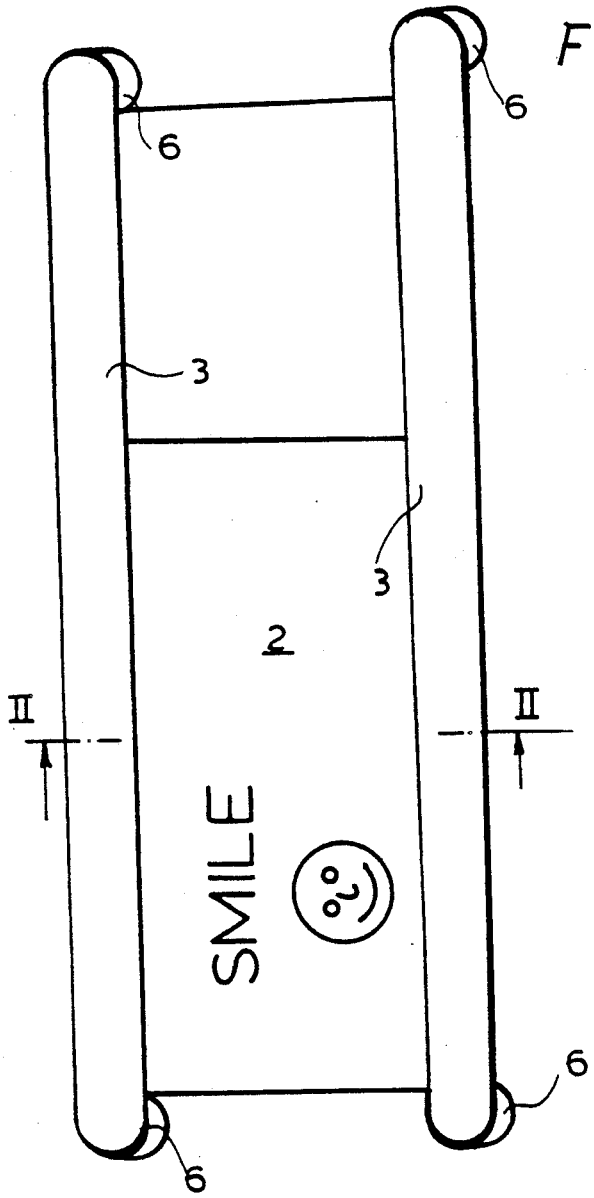
FIG. 1 is a perspective view of one embodiment of an information-bearing or direction-indicating sign according to my invention.
Figure 2:
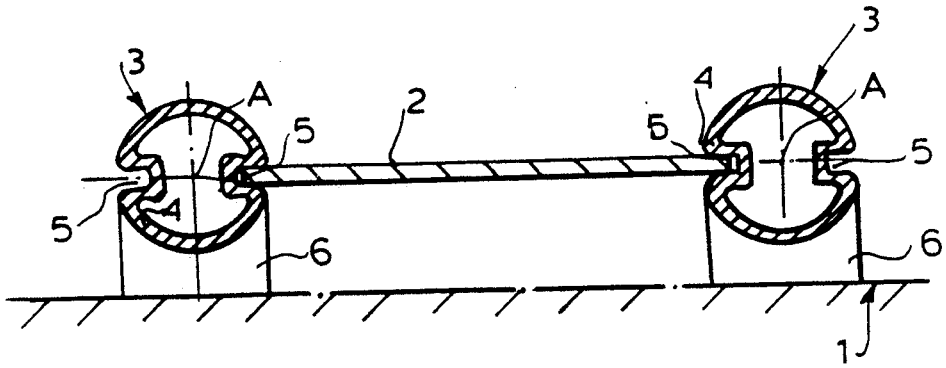
FIG. 2 is a cross-sectional view taken along the section line II—II of FIG. 1.

The information-bearing and/or direction-indicating sign shown in the drawing is equipped for mounting on a wall surface 1 indicated only in FIG. 2, e.g. beside a door or in the vicinity of an entrance for an office building or public building, such as a government office and court, hospital or the like. It comprises, in particular, a plurality of substantially rectangular information carriers 2, which can be provided with pictograms, symbols, printing or direction-indicating elements. The information carrier 2 is held by a frame 3, which mounts the information-bearing element or elements 2 on the wall surface 1.

Each information carrier 2 comprises a rectangular plate, while the frame 3 comprises at least two substantially parallel longitudinally-extended members 4, which are provided with longitudinally-running receiving grooves opposite each other, in which the information carrier is held at its edges and is inserted releasably.

The longitudinally-extended members 4 are provided with connecting pieces 6 which serve for attachment to the wall surface 1 or the like. To obtain a uniform screen size for the indicating elements the information carrier advantageously has a square form. It is however advantageous in individual cases to give the information carrier 2 a square form, wherein the length of the longitudinally extended members 4 can be adjusted accordingly.

Figure 3:
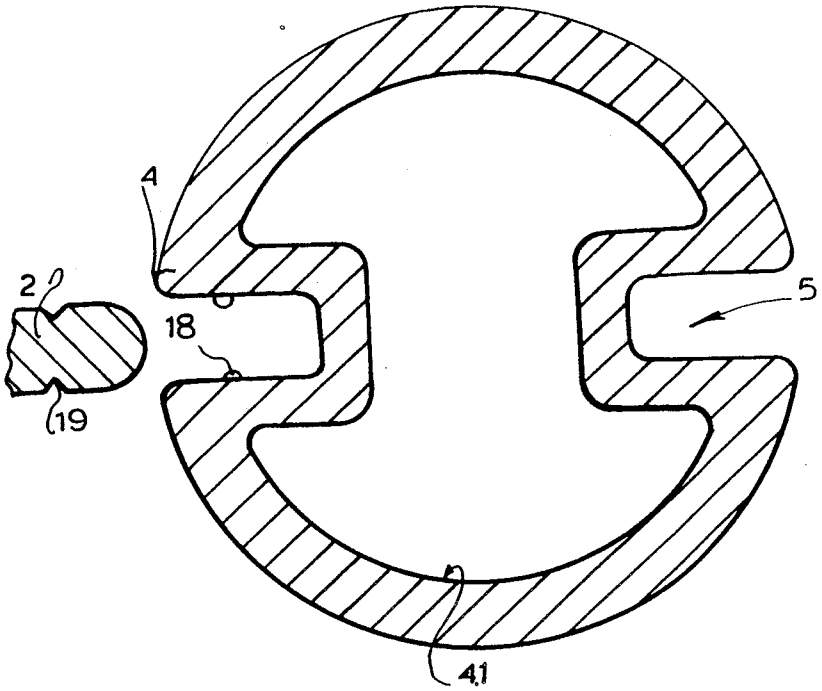
FIG. 3 is a cross-sectional view through one of the longitudinally-extended members, i.e. rods, used in the frame of the sign of FIG. 1.

In particular, the longitudinally-extended member 4 can have a circular cross section, in which the longitudinally-running receiving grooves 5 are aligned radially to the axis of the longitudinally-extended member 4. As indicated in FIG. 3, each longitudinally-extended member 4 has two receiving grooves 5 which are diametrically opposed. These longitudinally-extended members 4 can be made from an extruded plastic pipe and have a substantially uniform wall strength in the vicinity of the receiving grooves 5 and the other regions as seen in FIG. 2.

The connecting pieces 6 are formed from the angular pieces 7 indicated in detail in FIGS. 4a–4e. On one end of the angular pieces 7, a uniting portion 8 fitting the inside cross section of the plastic pipe is provided and on the other end a mounting piece 9 which has been rigidly attached to the wall 1 is detachably or releasably engaged after mounting. The uniting portion 8 is, as indicated particularly in the FIGS. 4a and 4b, formed by two semicircular parts 8', which contact inside the wall region 4.1 of the longitudinally-extended member 4 between the receiving grooves 5.

Figure 5A:
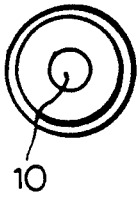
FIGS. 5a–5c are, respectively, end, elevational and cross-sectional views of a mounting piece for the connecting or angular piece.
Figure 5B:
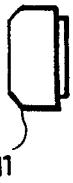
Figure 5C:
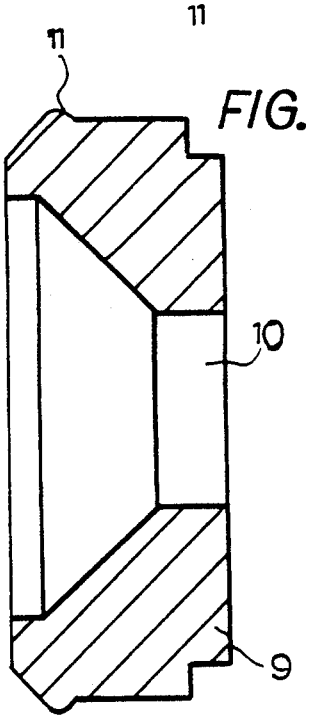
Figure 4A:
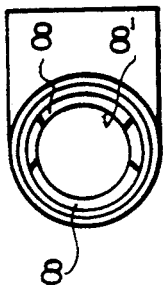
FIGS. 4a–4e end, elevational and cross-sectional and plan views of a part of a connecting piece, specifically an angular piece, for the longitudinally-extended members of the sign of FIG. 1.
Figure 4C:
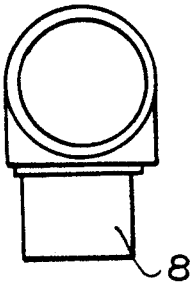
Figure 4D:
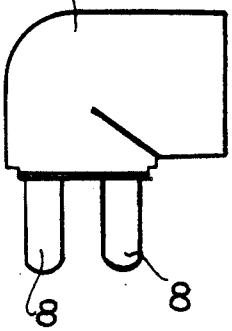
Figure 4B:
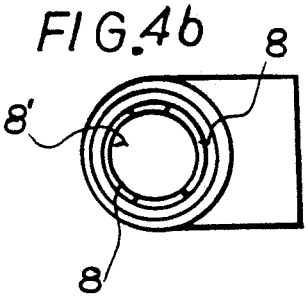
Figure 4E:
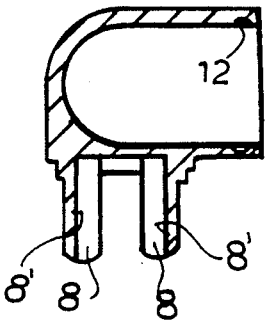

In the embodiment shown in FIGS. 5a–5c, the mounting piece 9 is formed as a cylindrical disk, which is provided with an axial passage 10 for a mounting screw. Further this mounting piece 9 carries a radially exteriorly protruding circular bulge 11, which is lockable in an annular groove 12 located inside the angular piece 7 In this way the longitudinally-extended members 4 can be easily snapped onto the mounting piece 9 after the information carrier 2 has been put in and similarly can be easily released, when for example an exchange or replacement of one or more of the information carriers 2 is required.

Figure 6A:
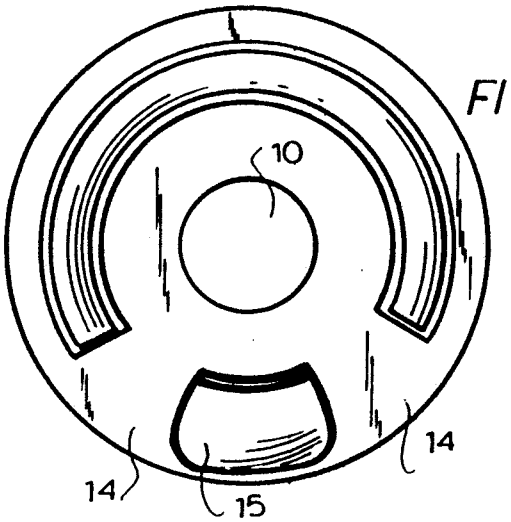
FIGS. 6a and 6b are an end and a longitudinal cross-sectional view of another form of a mounting piece for the angular piece.
Figure 6B:
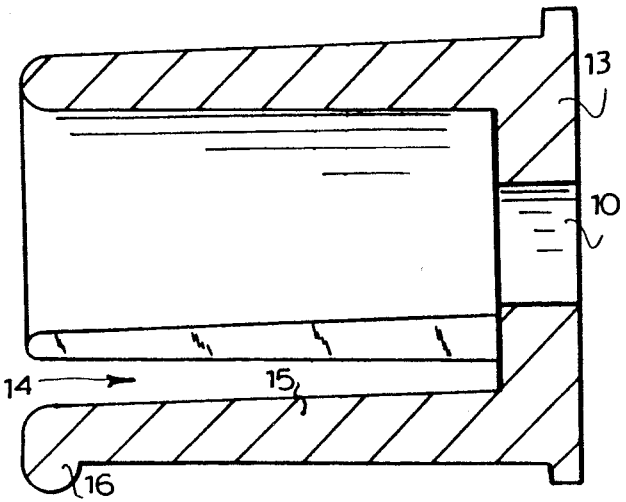
Figure 7A:
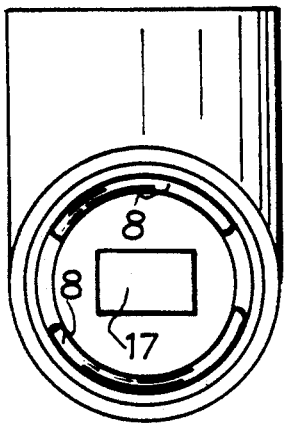
FIGS. 7a–7c are end, elevational and cross-sectional views of an angular piece for the attachment means of FIGS. 6a, 6b.
Figure 7B:
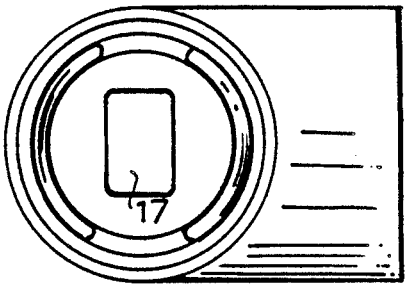
Figure 7C:
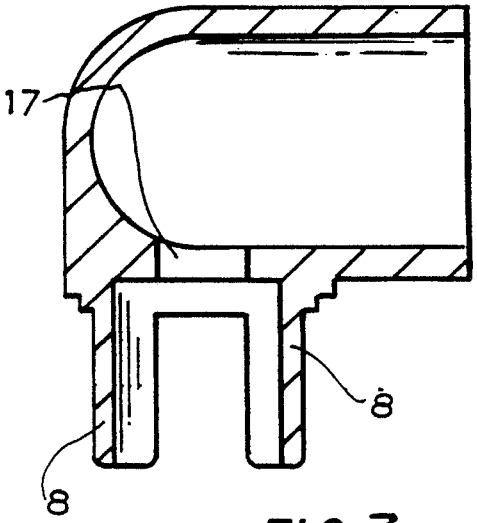

In FIGS. 6a and 6b an additional embodiment of the mounting piece 9 is shown, which comprises a cylindrical sleeve, whose one end is closed by a connector plate 13. The connector plate 13 is again provided with a passage 10 for an unshown attaching screw, by which the mounting piece 9 can be screwed to the wall surface. The cylindrical sleeve of the mounting piece 9 has a locking tongue 15 formed by two axially-extending openings, whose free end carries a radially outwardly directed locking lip 16. This locking lip 16 engages in a recess 17 in the cylindrical inner surface of the angular piece 7 apparent from FIGS. 7a–7c when the angular piece 7 is pushed on the mounting piece 9.

Finally, the receiving groove 5 can be provided with clamping crosspieces 18 running in their longitudinal direction on their opposing surfaces, as is indicated in the left half of FIG. 3. The clamping crosspiece engages in the locking groove 19 of the information carrier 2 only indicated in FIG. 3 and not yet inserted in the receiving groove 5.

I claim:

1. In an information-bearing and direction-indicating sign comprising at least one information carrier provided with an indicia selected from the group consisting of a printing, a pictogram and a direction-indicating symbol and a frame holding said information carrier, the improvement wherein each of said information carriers comprises a substantially rectangular plate and said frame comprises at least two longitudinally-extended members running substantially parallel to each other, which are provided with a plurality of opposing longitudinally-running receiving grooves, in which said information carriers are held edgewise and are removable, said longitudinally-extended members having a connecting piece at each end for attachment to a wall surface, said longitudinally-extended members comprising an extruded plastic pipe which has a substantially uniform wall thickness in a vicinity of said receiving grooves, said connecting piece being formed from an angular piece having first and second ends, said first end provided with a protruding uniting portion fitting an interior cross section of said plastic pipe, said second end being releasably insertable in a mounting piece rigidly attached to said wall surface.

2. The improvement defined in claim 1 in which said information carrier has a square shape.

3. The improvement defined in claim 1 in which said longitudinally-extended member has a substantially circular transverse cross section and said longitudinally-running receiving grooves are oriented radially to an axis of said longitudinally-extended member.

4. The improvement defined in claim 1 in which each of said longitudinally-extended members has two of said receiving grooves diametrically opposed.

5. The improvement defined in claim 1 in which said uniting portion is formed by two semicircular parts which contact a wall portion made of said longitudinally-extended member between said receiving grooves.

6. The improvement defined in claim 1 in which said mounting piece comprises a cylindrical disk, which is provided with an axial passage for attaching and carries a circular bulge protruding radially exteriorly, which locks in an annular groove located inside said angular piece.

7. The improvement defined in claim 1 in which said mounting piece comprises a cylindrical sleeve, whose one end is partially closed by a connector plate provided with an axial passage for attaching and has a locking tongue provided by two axially-extending openings, whose free end carries a radially outwardly-directed locking lip, which locks in a recess of a cylindrical inner surface of said angular piece.

8. An information-bearing and direction-indicating sign comprising:

at least one information carrier provided with an indicia selected from the group consisting of a printing, a pictogram and a direction-indicating symbol comprising a substantially rectangular plate; and a frame holding said information carrier comprising two circular-cross sectioned longitudinally-extended members which are plastic pipes running substantially parallel to each other and are provided with two diametrically opposed longitudinally-running receiving grooves, in which grooves said information carriers are held edgewise removably, said longitudinally-extended members having a connecting piece at each end for attachment, said connecting piece being framed from an angular piece having a first and second end, said first end being provided with a protruding uniting portion fitting an interior cross section of said plastic pipe, said second end releasably insertable into a mounting piece rigidly attachable to a wall surface, said uniting portion being formed by two semicircular parts which contact a wall portion of said longitudinally-extended member between said receiving grooves and said mounting piece comprising a cylindrical disk, which is provided with an axial passage for attaching and carries a circular bulge protruding radially exteriorly, which locks in an annular groove located inside said angular piece.

9. An information-bearing and direction-indicating sign comprising:

at least one information carrier provided with an indicia selected from the group consisting of a printing, a pictogram and a direction-indicating symbol comprising a rectangular plate; and a frame holding said information carrier comprising two circular-cross sectioned longitudinally-extended members which are plastic pipes running substantially parallel to each other and are provided with two diametrically opposed longitudinally-running receiving grooves, in which grooves said information carriers are held edgewise removably, said longitudinally-extended members having a connecting piece at each end for attachment to a wall surface, said connecting piece being formed from an angular piece having a first and second end, said first end being provided with a protruding uniting portion fitting an interior cross section of said plastic pipe, said second end releasably pushed into a mounting piece rigidly attached to said wall surface, said uniting portion being formed by two semicircular parts which contact a wall portion of said longitudinally-extended member between said receiving grooves and said mounting piece comprising a cylindrical sleeve, whose one end is closed by a connector plate provided with an axial passage for attaching and has a locking tongue provided by two axially extended openings, whose free end carries a radially outwardly-directed locking lip, which locks in a recess of the cylindrical inner surface of said angular piece.

10. In an information-bearing and direction-indicating sign comprising at least one information carrier provided with an indicia selected from the group consisting of a printing, a pictogram and a direction-indicating symbol and a frame holding said information carrier, the improvement wherein said information carrier comprises a substantially rectangular plate and said frame comprises at least two longitudinally-extended members running substantially parallel to each other, which are provided with a plurality of opposing longitudinally-running receiving grooves, in which said information carriers are held edgewise and are removable, said longitudinally-extended members having a connecting piece at each end for attachment to a wall surface, said longitudinally-running receiving grooves being provided with a plurality of clamping cross pieces running longitudinally in said receiving grooves on opposing surfaces in said receiving grooves, and said clamping cross pieces having a semicircular cross section and engaging in locking grooves of said information carrier.

* * * * *